US011059628B2

(12) United States Patent
Alatriste

(10) Patent No.: US 11,059,628 B2
(45) Date of Patent: Jul. 13, 2021

(54) FOOD STORAGE BAG WITH INTEGRATED CLOSURE DEVICE AND RELATED METHODS

(71) Applicant: Anthony Alatriste, Windermere, FL (US)

(72) Inventor: Anthony Alatriste, Windermere, FL (US)

( * ) Notice: Subject to any disclaimer, the term of this patent is extended or adjusted under 35 U.S.C. 154(b) by 0 days.

(21) Appl. No.: 16/118,652

(22) Filed: Aug. 31, 2018

(65) Prior Publication Data

US 2019/0092531 A1 Mar. 28, 2019

Related U.S. Application Data

(60) Provisional application No. 62/552,617, filed on Aug. 31, 2017.

(51) Int. Cl.

| | |
|---|---|
| ***B65D 33/00*** | (2006.01) |
| ***B65D 33/16*** | (2006.01) |
| ***B65D 85/36*** | (2006.01) |
| ***B65D 77/16*** | (2006.01) |
| ***B65D 33/30*** | (2006.01) |
| ***B65D 75/16*** | (2006.01) |

(52) U.S. Cl.

CPC ..... *B65D 33/165* (2013.01); *B65D 33/30* (2013.01); *B65D 75/16* (2013.01); *B65D 77/16* (2013.01); *B65D 85/36* (2013.01)

(58) Field of Classification Search

CPC ..... B65D 33/165; B65D 33/30; B65D 75/16; B65D 77/16; B65D 85/36

See application file for complete search history.

(56) References Cited

U.S. PATENT DOCUMENTS

| | | | | | |
|---|---|---|---|---|---|
| 331,357 | A * | 12/1885 | Wineberger | B65D 33/20 | 383/89 |
| 651,937 | A * | 6/1900 | Short | B65D 33/30 | 383/70 |
| 892,330 | A * | 6/1908 | Tavis | B65D 33/20 | 383/89 |
| 2,210,859 | A * | 8/1940 | Schafer | B65D 33/30 | 383/78 |
| D191,145 | S | 8/1961 | Cesareo | | |
| 3,201,030 | A * | 8/1965 | Pollack | B65D 75/52 | 383/43 |
| 3,402,052 | A * | 9/1968 | Walker | B65D 33/30 | 426/126 |

(Continued)

OTHER PUBLICATIONS

Rectangular Acetate Gift Boxes.[online] Published on Jul. 10, 2007. Retrieved May 28, 2018 from URL: https://www.amazon.co.uk/Rectangular -Acetate-Gift -Boxes-Avai lable/d p/BOOOT EN P90; pp. 4.

*Primary Examiner* — Peter N Helvey

(74) *Attorney, Agent, or Firm* — Allen, Dyer, Doppelt + Gilchrist, PA

(57) ABSTRACT

A food storage bag may include a flexible substrate defining first and second opposing sidewalls, a closed bottom and an open top, and first and second wires extending along the first and second sidewalls of the flexible substrate. The first and second wires may each have a shape defining a series of peaks and troughs such that the opposing peaks and troughs may be twisted together to close the flexible substrate at different lengths along the first and second sidewalls.

17 Claims, 13 Drawing Sheets

(56) References Cited

U.S. PATENT DOCUMENTS

| | | | | | |
|---|---|---|---|---|---|
| 3,462,067 | A * | 8/1969 | Shore | B65D 33/02 | 383/104 |
| 3,537,636 | A * | 11/1970 | Rochette | B65D 33/02 | 383/89 |
| 3,754,371 | A * | 8/1973 | Walker, III | B65B 51/00 | 53/483 |
| 4,051,994 | A | 10/1977 | Donk | | |
| 4,267,768 | A | 5/1981 | Cieslak et al. | | |
| D369,317 | S | 4/1996 | Weder et al. | | |
| 5,766,399 | A * | 6/1998 | Clark | B29C 65/42 | 156/244.12 |
| D434,913 | S | 12/2000 | Schmidt et al. | | |
| 6,238,090 | B1 * | 5/2001 | Yuter | B65D 21/08 | 383/2 |
| D447,685 | S | 9/2001 | Chagnon et al. | | |
| D495,252 | S | 8/2004 | Poole | | |
| D601,435 | S | 10/2009 | Fell et al. | | |
| 7,665,895 | B2 * | 2/2010 | Takita | B65D 33/02 | 383/107 |
| D619,477 | S | 7/2010 | Frizell et al. | | |
| D638,702 | S | 5/2011 | Lowery et al. | | |
| 7,993,256 | B2 * | 8/2011 | Takita | B65D 33/02 | 383/88 |
| 9,102,443 | B2 * | 8/2015 | Fisher | B65D 33/165 | |
| D770,282 | S | 11/2016 | Ye et al. | | |
| D813,663 | S | 3/2018 | Sanfilippo et al. | | |
| D813,667 | S | 3/2018 | Shimizu | | |
| D843,224 | S * | 3/2019 | Alatriste | D9/703 | |
| 2004/0234175 | A1 * | 11/2004 | Takita | B65D 33/02 | 383/88 |
| 2006/0285779 | A1 * | 12/2006 | Golas | B65D 33/165 | 383/90 |

* cited by examiner

FOOD STORAGE BAG WITH INTEGRATED CLOSURE DEVICE AND RELATED METHODS

RELATED APPLICATIONS

This application claims the benefit of provisional application Ser. No. 62/552,617 filed Aug. 31, 2017, which is hereby incorporated herein in its entirety by reference.

TECHNICAL FIELD

The present disclosure relates to food storage devices, and more particularly, to food storage bags and related methods.

BACKGROUND

Food storage bags are routinely used to help preserve the freshness of food items, such as bread and the like. To hold such a bag in a closed position, one of two devices are typically used. One is a simple wire tie. The user twists the bag up at the desired position along its length, and then twists the wire tie around the bag at the desired location to hold the twisted portion of the bag in place. Another similar device is a plastic clip, which works in much the same way as a wire tie except it is pressed onto the bag at the desired location along the length of the bag to hold the twisted portion in place, rather than twisting a wire tie around it.

While wire ties and clips are advantageous in that they can be moved along the length of the bag to close it at different positions, they are also easy to misplace. This can result in the user not bothering to close the bag correctly, and accordingly a premature spoliation of the food product.

Various approaches have been developed to address these shortcomings. One such approach is set forth in U.S. Pat. No. 4,267,768 to Cieslak et al. This reference discloses a reclosable bag utilizing one or more inelastic strands of material secured in spaced apart relation to the walls of the bag over a part or the entire length of the bag. To close the bag, the strand is wound or twisted about the bag at a point intermediate the open end of the bag and its contents to thereby achieve closure.

Despite the existence of such systems, further improvements may be desirable for food storage bags to provide enhanced convenience and usability.

SUMMARY

A food storage bag may include a flexible substrate defining first and second opposing sidewalls, a closed bottom and an open top, and first and second wires extending along the first and second sidewalls of the flexible substrate. The first and second wires may each have a shape defining a series of peaks and troughs such that the opposing peaks and troughs may be twisted together to close the flexible substrate at different lengths along the first and second sidewalls.

The peaks and troughs of the first and second wires may be offset from one another such that the peaks of one are aligned with the troughs of the other. Furthermore, the shapes of the first and second wires may define sinusoidal patterns, triangular patterns, square wave patterns, etc. Furthermore, the food storage bag of may further include a third wire extending across the bottom of the flexible substrate. By way of example, the third wire may extend straight across the closed bottom.

The flexible substrate may have a rectangular shape further defining opposing top and bottom sidewalls coupled to the first and second opposing sidewalls. The first and second wires may be integrally formed with the flexible substrate in one example implementation, or secured to the first and second sidewalls with an adhesive in another example implementation.

A related method for making a food storage bag may include forming a flexible substrate defining first and second opposing sidewalls, a closed bottom and an open top. The method may further include coupling first and second wires to the flexible substrate extending along the first and second sidewalls of the flexible substrate, with the first and second wires each having a shape defining a series of peaks and troughs such that the opposing peaks and troughs may be twisted together to close the flexible substrate at different lengths along the first and second sidewalls.

DETAILED DESCRIPTION

Figure 14:
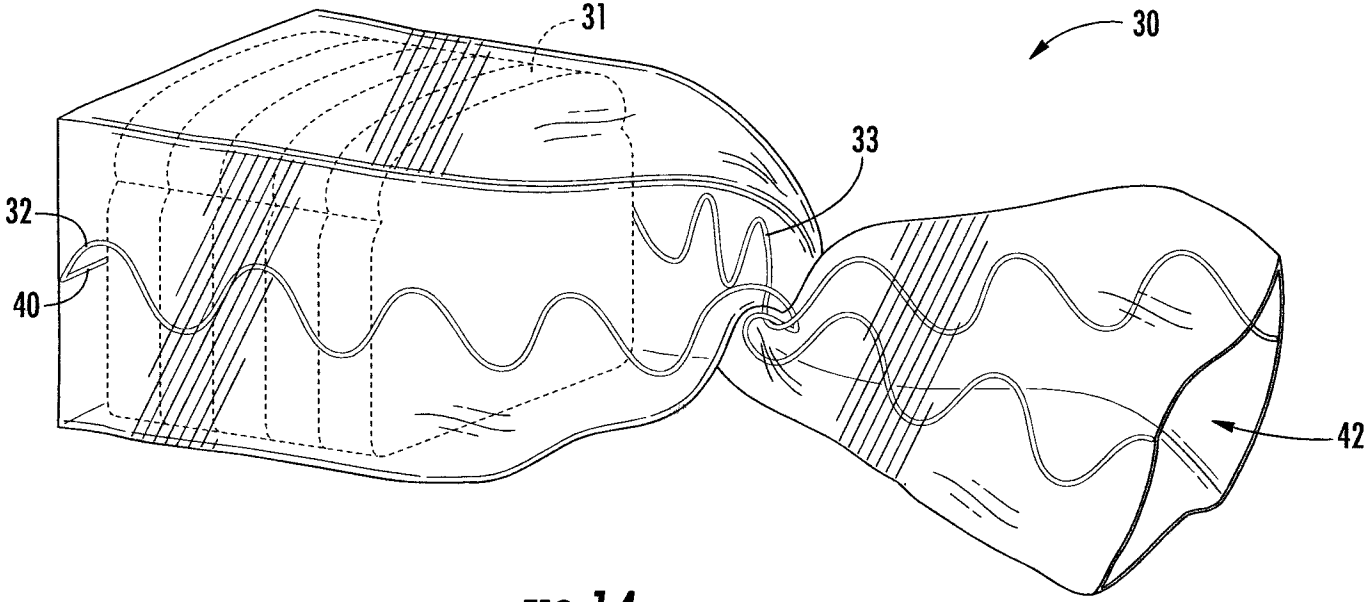
FIG. 14 is a perspective view of the food storage bag of FIG. 1 in a closed position.

Referring initially to FIGS. 1-7 and 14, a food storage bag 30 is first described which may be used for storing food items such as bread 31 (FIG. 14), fruits and vegetables, etc. In the illustrated example, the bag 30 includes first and second wires or strands 32, 33 which run along the left and right hand sides 34, 35 of the bag (see FIGS. 4 and 5). In this example, the wires 32, 33 are in a generally sinusoidal pattern. Moreover, the first and second wires 32, 33 may optionally be offset from one another such that the peaks of one are aligned with the troughs of the other (i.e., the may be considered out of phase to one another). This allows the wires 32, 33 to be twisted together as shown in FIG. 14 at various lengths along the bag 30 to close it in different positions. Thus, as the amount of food within the bag 30 is reduced (e.g., as bread slices 31 are removed in the example of FIG. 14), the bag may accordingly be re-sealed or re-closed further and further down the bag to help keep the remaining food fresh.

In the illustrated example, an optional wire (shown with a dashed line in FIGS. 1-3) also extends across the bottom 41 of the bag as well to provide additional support in the bottom of the bag. As such, when the bag is held from the top 42, this helps reinforce the bottom to keep the weight of the food inside from breaking through the bottom of the bag. It should be noted that although the bottom wire 40 is shown as being straight in FIGS. 1-3, in other embodiments the wire could take other shapes. For example, the wire 40 may also be sinusoidal or another pattern such as those described further below. Furthermore, more than one wire 40 may be used on the bottom 41 or the sides 34, 35 of the bag 30 in different embodiments.

Figure 1:
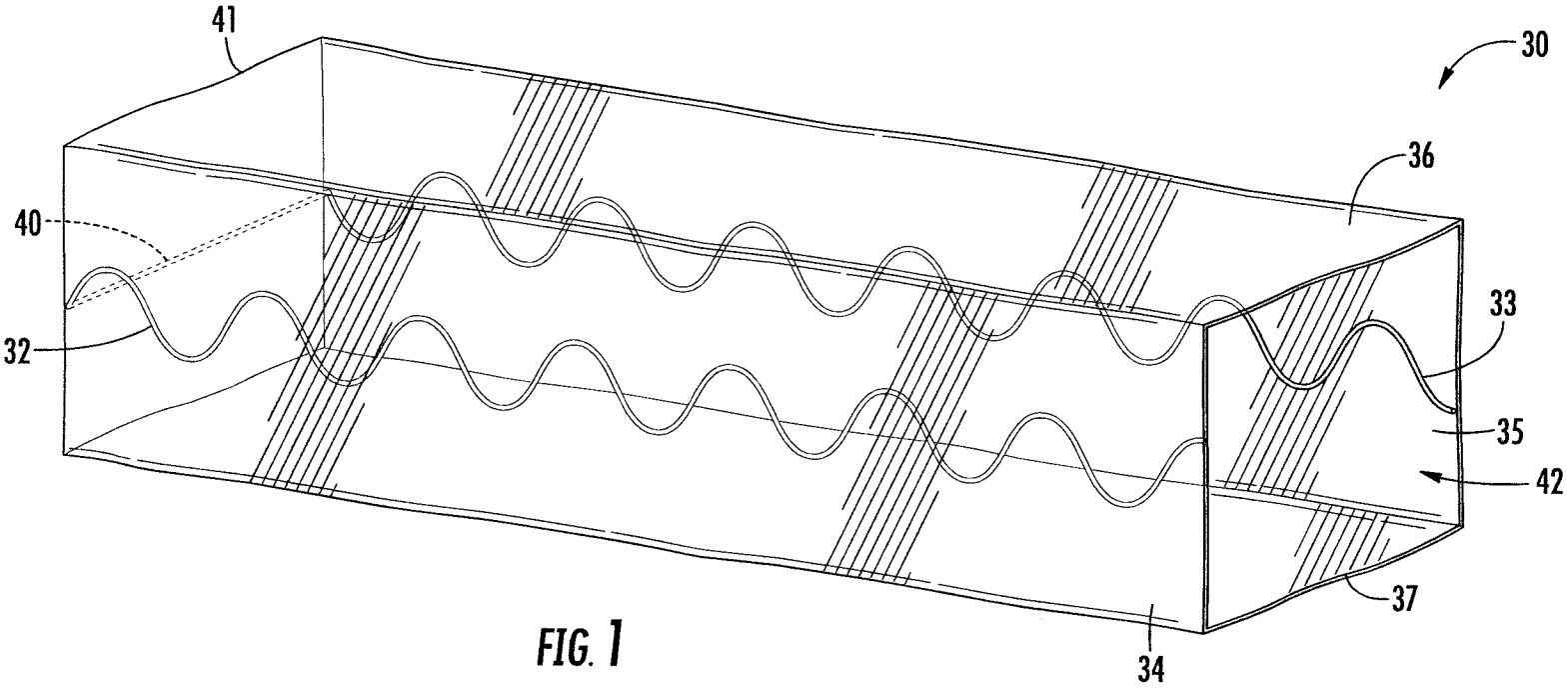
FIG. 1 is a perspective view of a food storage bag having an integrated wire closure arrangement in accordance with an example embodiment in an open position.
Figure 2:
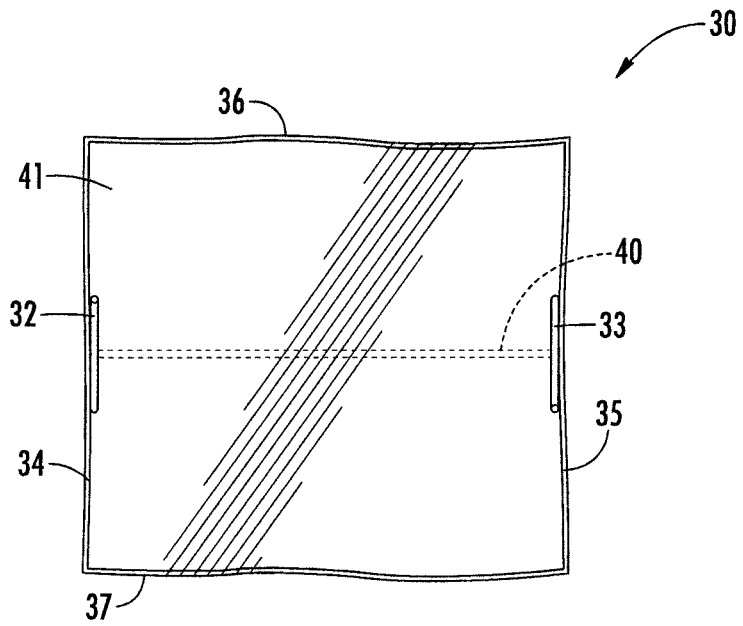
FIG. 2 is a front end view of the food storage bag of FIG. 1.
Figure 3:
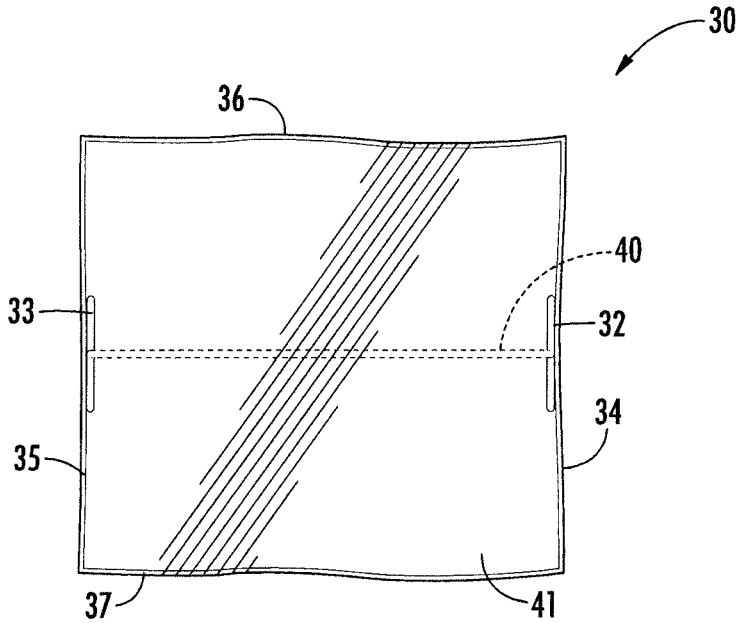
FIG. 3 is a back end view of the food storage bag of FIG. 1.
Figure 4:
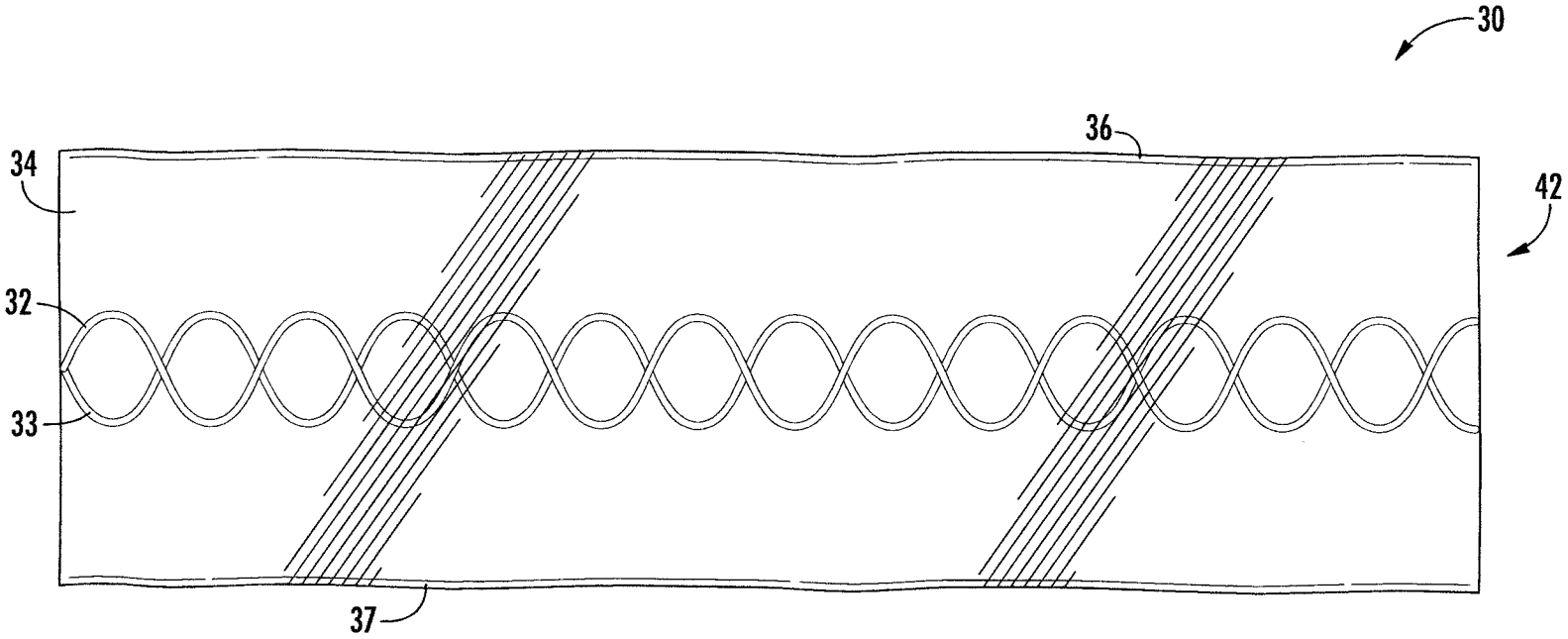
FIG. 4 is a right-side view of the food storage bag of FIG. 1.
Figure 5:
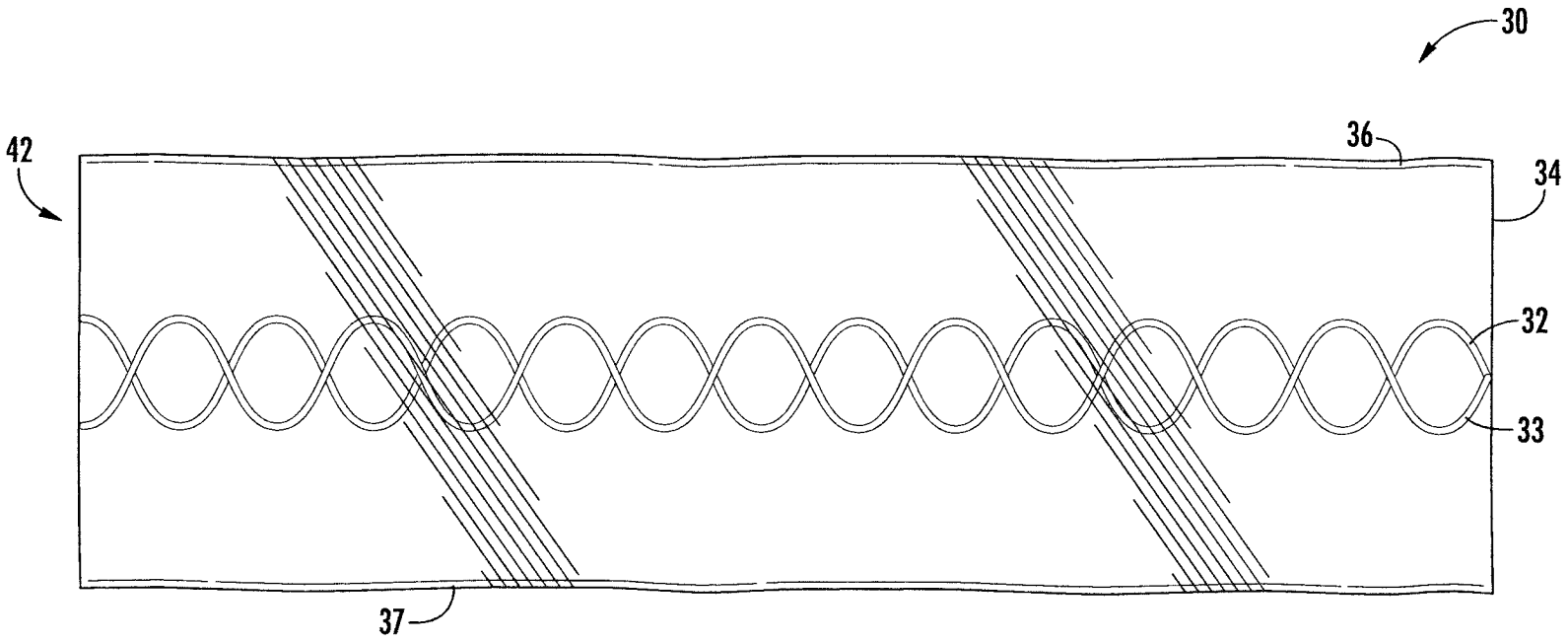
FIG. 5 is a left-side view of the food storage bag of FIG. 1.
Figure 6:
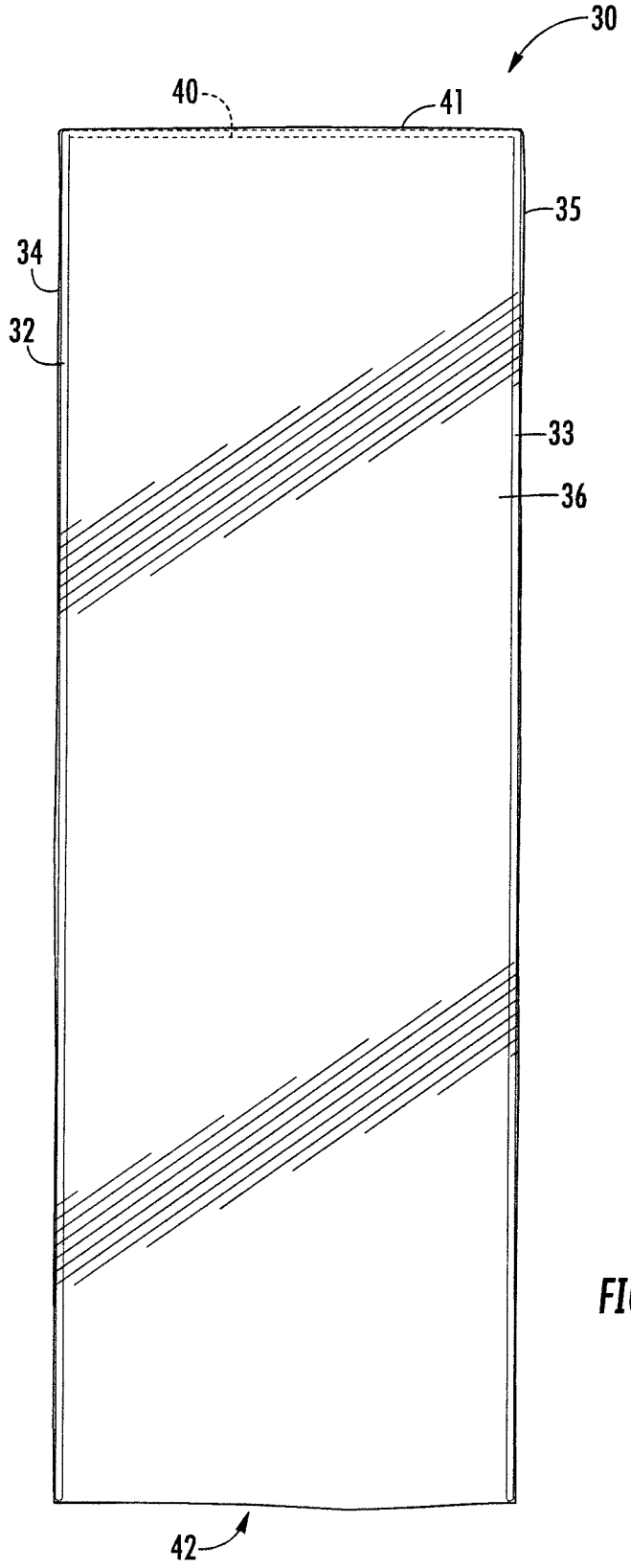
FIG. 6 is a top view of the food storage bag of FIG. 1.
Figure 7:
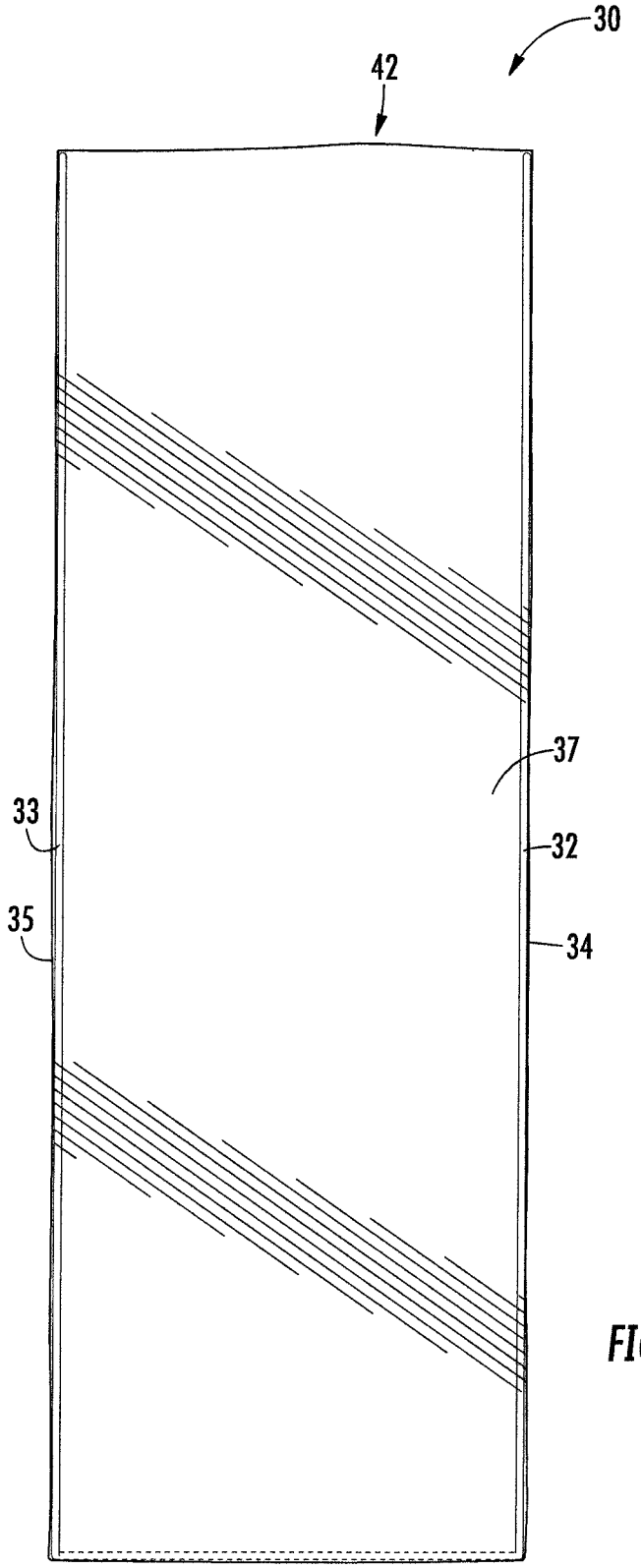
FIG. 7 is a bottom view of the food storage bag of FIG. 1.
Figure 8:
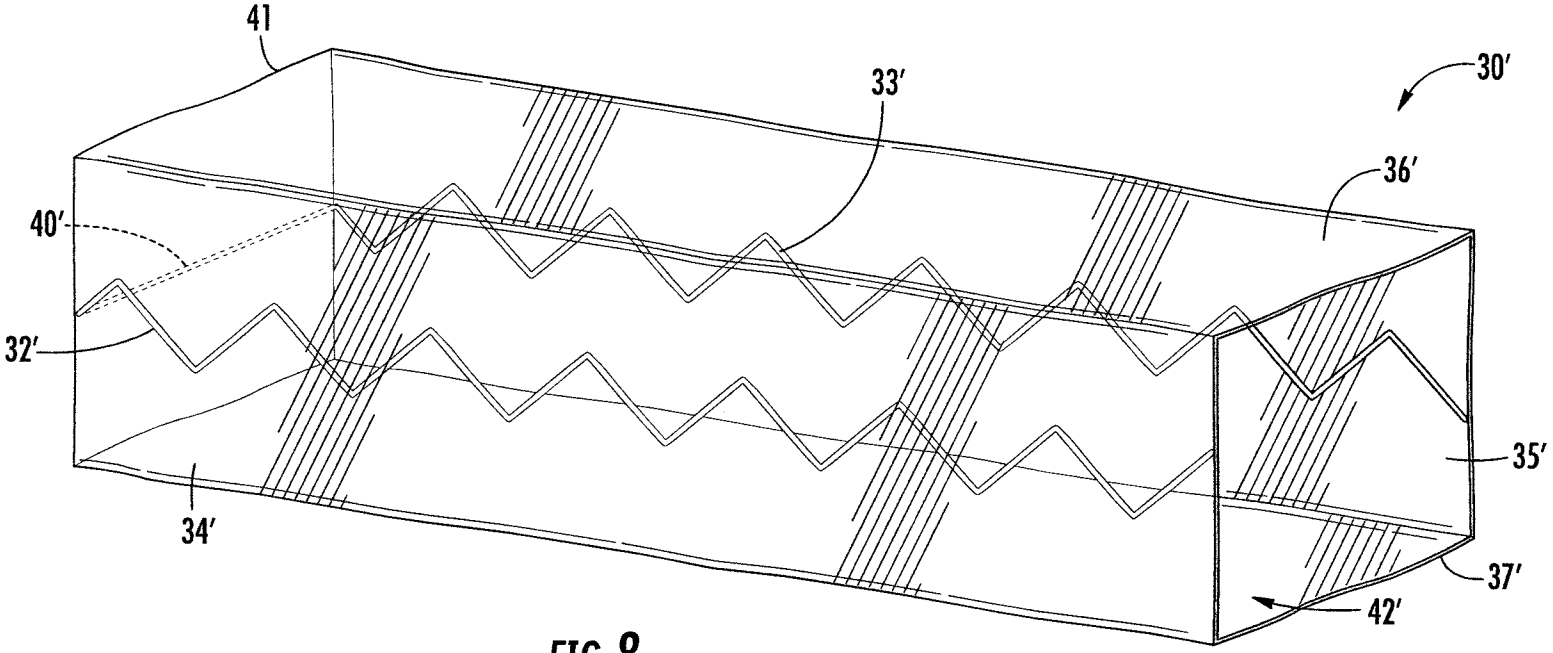
FIG. 8 is a perspective view of another embodiment of a food storage bag in accordance with an example embodiment including a different wire closure arrangement.
Figure 9:
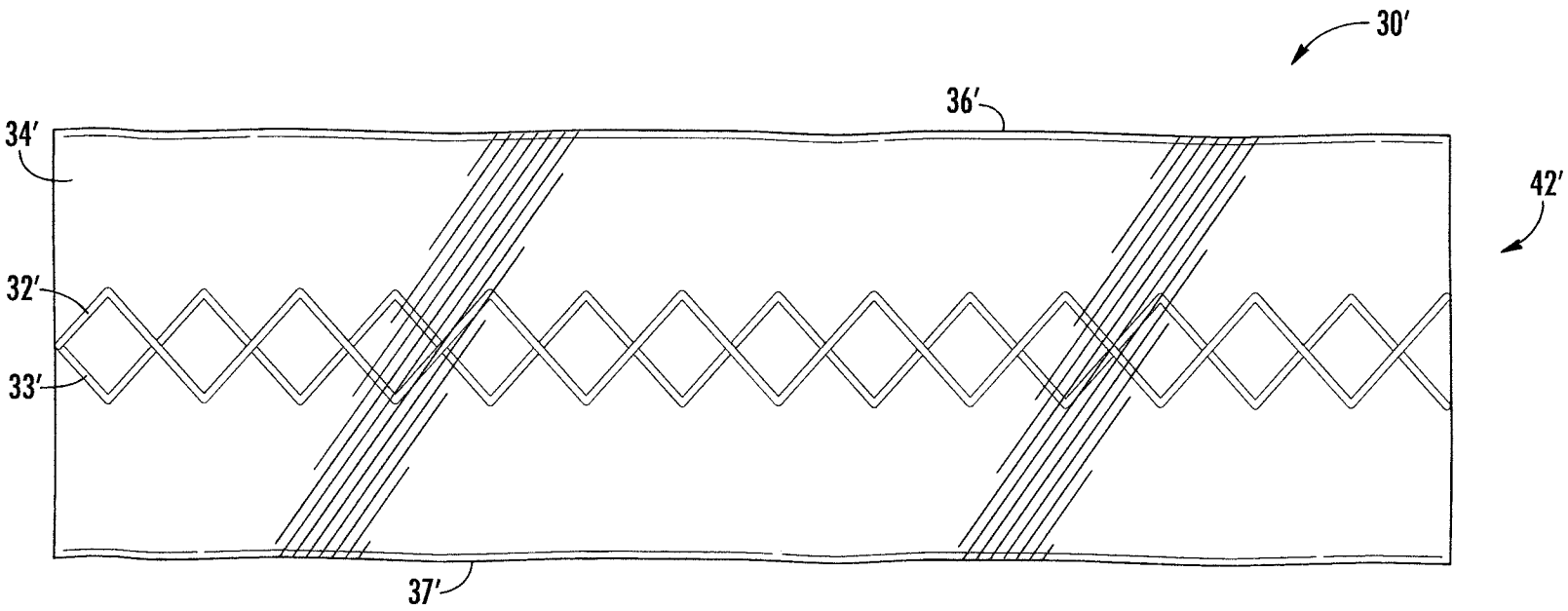
FIG. 9 is a right-side view the food storage bag of FIG. 8.
Figure 10:
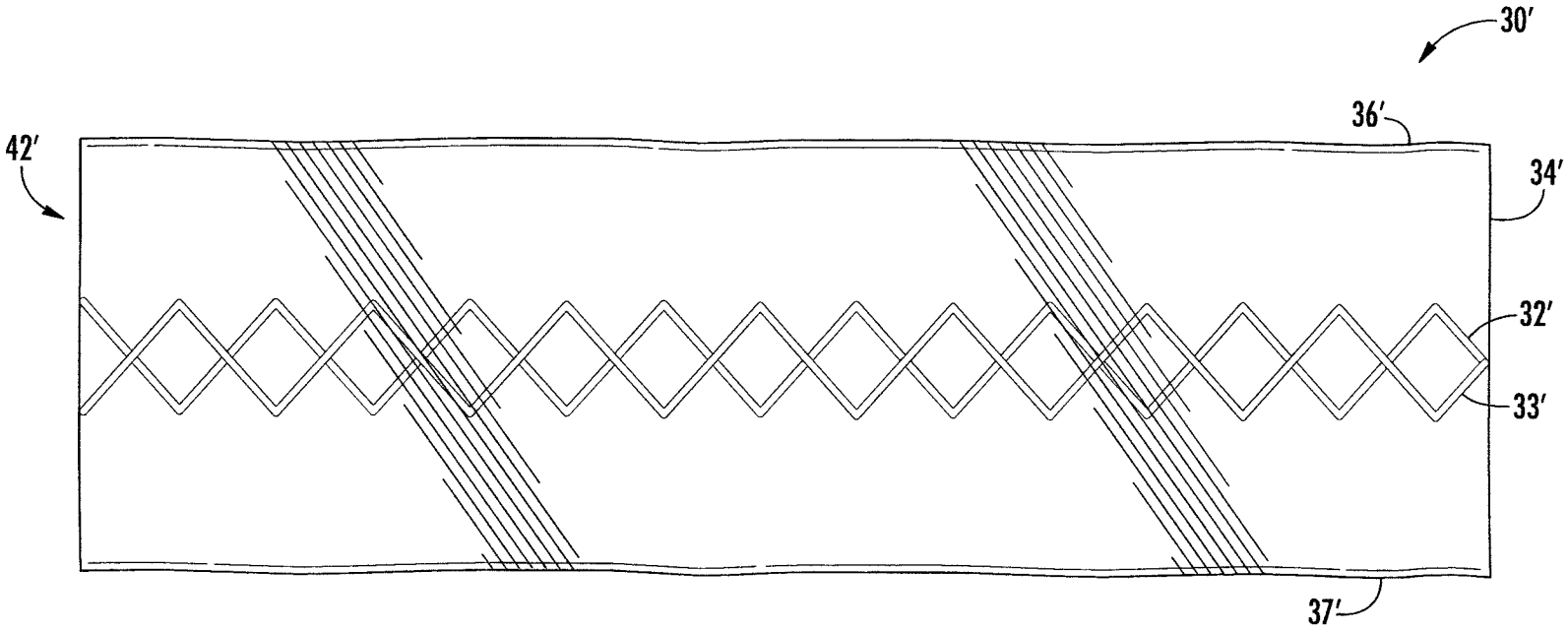
FIG. 10 is a left-side view of the food storage bag of FIG. 8
Figure 11:
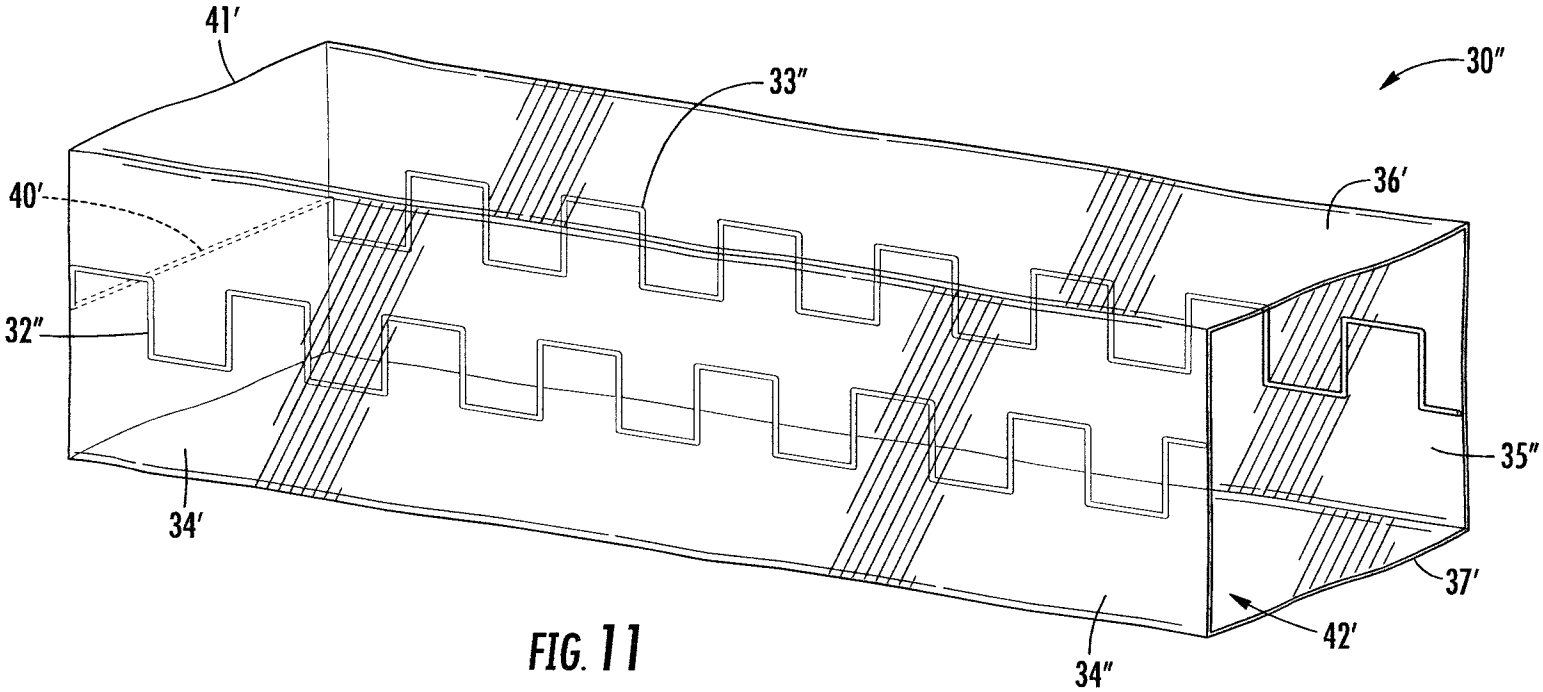
FIG. 11 is a perspective view of still another embodiment of a food storage bag in accordance with an example embodiment including a different wire closure arrangement.
Figure 12:
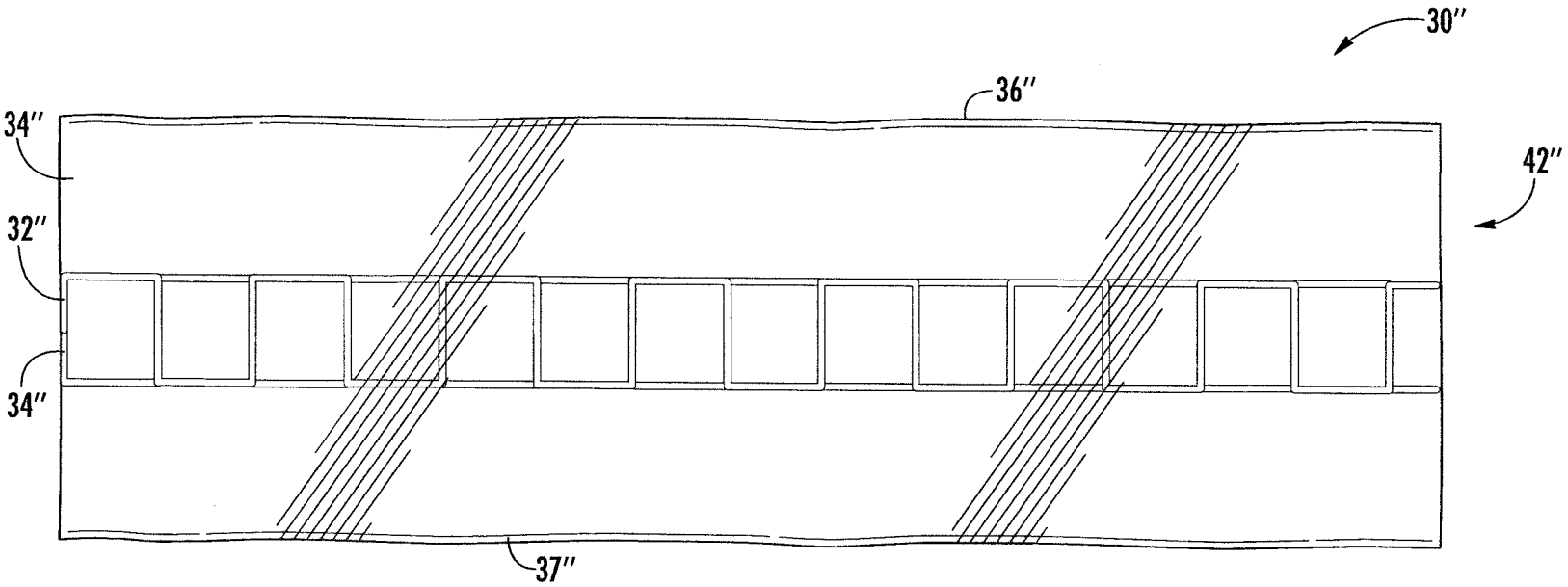
FIG. 12 is a right-side view of the food storage bag of FIG. 11.
Figure 13:
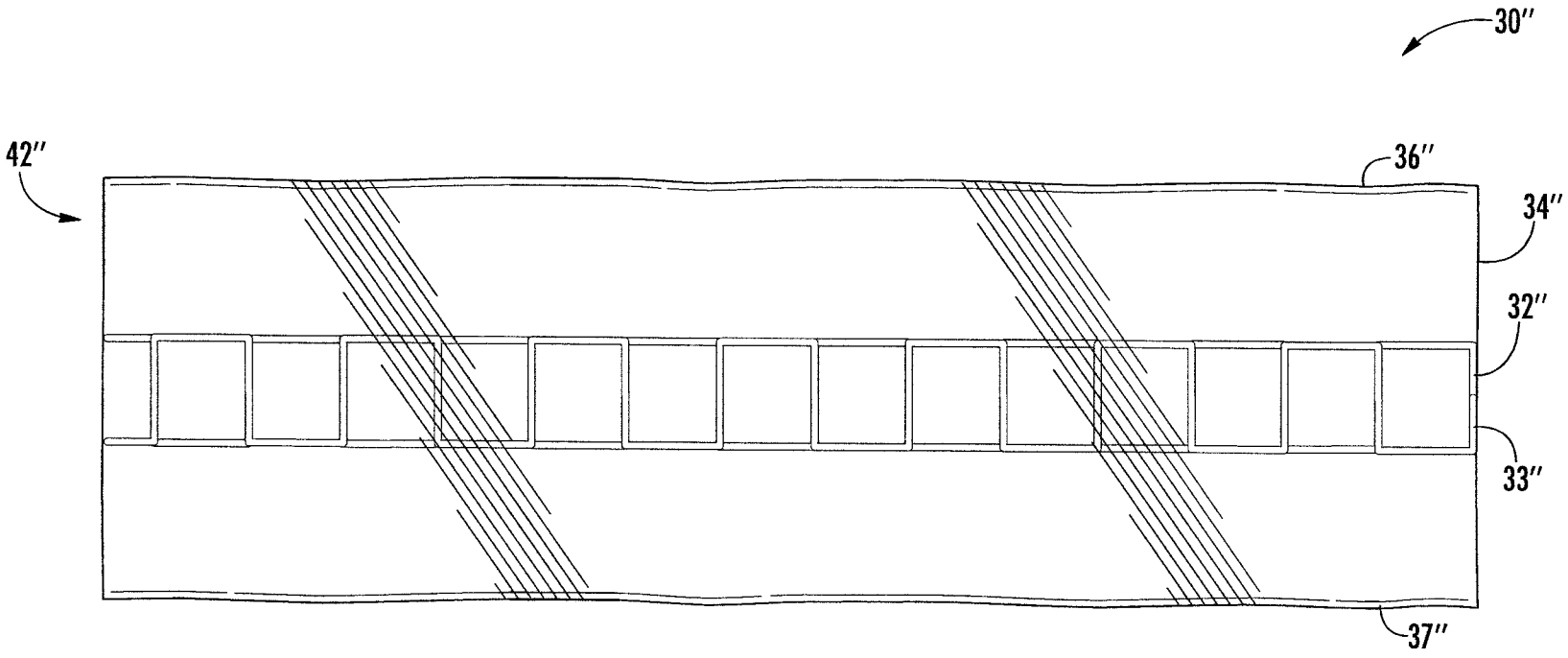
FIG. 13 is a left-side view of the food storage bag of FIG. 11.

In accordance with another example embodiment now described with reference to FIGS. 8-10, the first and second wires 32', 33' along the sides 34', 35' of the bag 30' may have a generally sawtooth or triangular pattern. In still another embodiment shown in FIGS. 11-13, the first and second wires 32", 33" have a generally square wave pattern. As with the embodiment shown in FIG. 1, here again the peaks/valleys of the triangular or square waves may optionally be offset (i.e., be out of phase) as between the first and second wires to help facilitate their closure when twisted together. Moreover, the wire patterns in the above-described embodiments may instead by on the front and back sides of the bag, or on all sides. Moreover, the wire patterns may be used on other shapes of bags besides the rectangular shape shown. That is, they may be placed on opposing sidewalls of various shapes of flexible food bags (e.g., cylindrical, etc.).

Generally speaking, the substrate of the food storage bag 30 may be a flexible plastic or paper, etc. The first and second wires 32, 33 may be metal, although they need not be metal in all embodiments. Generally speaking, the wires 32, 33, 40 may be formed of a material that is generally shape retaining (or inelastic), but malleable enough to be twisted together and hold in the twisted position to keep the bag 30 in the closed position.

The wires 32, 33, 40 may be integrally formed in the substrate. That is, the plastic or other material used for the substrate may be melted onto or formed around the wires so that they are at least partially within the substrate. In other configurations, the wires could be secured to the inside or outside of the bag with a suitable adhesive.

The food storage bag 30 accordingly allows for relatively easy closing and opening of the bag by untwisting or twisting the first and second wires 32, 33 apart or together, respectively. Yet, because there are no separate wire ties or clips to misplace, this helps ensure that the user will properly close and seal the bag 30 after each use to retain the freshness of the food item therein, and avoid premature staleness or expiration of the food item.

Many modifications and other embodiments will come to the mind of one skilled in the art having the benefit of the teachings presented herein. Therefore, it is understood that the disclosure is not to be limited to the specific exemplary embodiments disclosed herein.

That which is claimed is:

1. A food storage bag comprising a flexible plastic substrate defining first and second opposing sidewalls, a closed bottom and an open top;

first and second wires extending along the first and second sidewalls of the flexible plastic substrate, the first and second wires each having a shape defining a series of peaks and troughs such that the opposing peaks and troughs may be twisted together to close the flexible plastic substrate at different lengths along the first and second sidewalls; and a one-piece third wire extending fully continuously across the bottom of the flexible plastic substrate and connected to the first and second wires.

2. The food storage bag of claim 1 wherein the peaks and troughs of the first and second wires are offset from one another such that the peaks of one are aligned with the troughs of the other.

3. The food storage bag of claim 1 wherein the shapes of the first and second wires define sinusoidal patterns.

4. The food storage bag of claim 1 wherein the shapes of the first and second wires define triangular patterns.

5. The food storage bag of claim 1 wherein the shapes of the first and second wires define square wave patterns.

6. The food storage bag of claim 1 wherein the third wire extends straight across the closed bottom.

7. The food storage bag of claim 1 wherein the flexible plastic substrate has a rectangular shape further defining opposing top and bottom sidewalls coupled to the first and second opposing sidewalls.

8. The food storage bag of claim 1 wherein the first and second wires are integrally formed with the flexible plastic substrate.

9. The food storage bag of claim 1 wherein the first and second wires are secured to the first and second sidewalls with an adhesive.

10. A food storage bag comprising a flexible plastic substrate defining a rectangular shape with opposing top and bottom sidewalls, first and second opposing sidewalls coupled between the top and bottom sidewalls, a closed bottom and an open top;

first and second wires extending along the first and second sidewalls of the flexible plastic substrate, the first and second wires each having a sinusoidal shape defining a series of peaks and troughs such that the opposing peaks and troughs may be twisted together to close the flexible plastic substrate at different lengths along the first and second sidewalls; and a one-piece third wire extending fully continuously across the bottom of the flexible plastic substrate and connected to the first and second wires.

11. The food storage bag of claim 10 wherein the peaks and troughs of the first and second wires are offset from one another such that the peaks of one are aligned with the troughs of the other.

12. A method for making a food storage bag comprising forming a flexible plastic substrate defining first and second opposing sidewalls, a closed bottom and an open top;

coupling first and second wires to the flexible plastic substrate extending along the first and second sidewalls of the flexible plastic substrate, the first and second wires each having a shape defining a series of peaks and troughs such that the opposing peaks and troughs may be twisted together to close the flexible plastic substrate at different lengths along the first and second sidewalls; and coupling a one-piece third wire extending fully continuously across the bottom of the flexible plastic substrate and connected to the first and second wires.

13. The method of claim 12 wherein the peaks and troughs of the first and second wires are offset from one another such that the peaks of one are aligned with the troughs of the other.

14. The method of claim 12 wherein the shapes of the first and second wires define sinusoidal patterns.

15. The method of claim 12 wherein the shapes of the first and second wires define triangular patterns.

16. The method of claim 12 wherein the shapes of the first and second wires define square wave patterns.

17. The method of claim 12 wherein coupling comprises integrating the first and second wires within the sidewalls of the flexible plastic substrate.

* * * * *